United States Patent [19]

Tamano et al.

[11] 3,939,319

[45] Feb. 17, 1976

[54] HIGH-FREQUENCY HEATING DEVICE FOR VARIABLY CONTROLLING A HIGH FREQUENCY OUTPUT IN A CONTINUOUS OR STEPWISE MANNER

[75] Inventors: Motokazu Tamano, Yokohama; Tomimitsu Noda; Masanobu Yoshioka, both of Fuji, all of Japan

[73] Assignee: Tokyo Shibaura Electric Co., Ltd., Kawasaki, Japan

[22] Filed: Jan. 31, 1974

[21] Appl. No.: 438,403

[30] Foreign Application Priority Data

Feb. 7, 1973 Japan ..... 48-15296

[52] U.S. Cl. .. 219/10.55 B; 307/247 R; 307/252 T; 323/225 C; 323/24; 331/87

[51] Int. Cl.[2] ..... H05B 9/06

[58] Field of Search ..... 219/10.55, 10.55 B; 323/225 C, 24, 34, 38; 307/252 N, 252 T, 293, 247 R; 331/86, 87; 321/4

[56] References Cited

UNITED STATES PATENTS

| | | | |
|---|---|---|---|
| 3,510,686 | 5/1970 | Zug | 307/252 N |
| 3,735,237 | 5/1973 | Derby | 219/10.55 B |
| 3,780,252 | 12/1973 | Crapuchettes | 219/10.55 |
| 3,793,531 | 2/1974 | Ferrigno | 323/24 |

FOREIGN PATENTS OR APPLICATIONS

| | | | |
|---|---|---|---|
| 25,762 | 7/1966 | Japan | 219/10.55 |

*Primary Examiner*—Bruce A. Reynolds
*Attorney, Agent, or Firm*—Oblon, Fisher, Spivak, McClelland & Maier

[57] ABSTRACT

A high-frequency heating device includes an AC power source, a high-tension transformer, a triac thyristor connected between the primary winding of the high-tension transformer and the power source, a magnetron coupled to the secondary winding of the high-tension transformer, a signal generating circuit for generating upon energization a signal at a predetermined phase of each cycle of the power source voltage, an astable multivibrator for generating pulses whose pulse width is variable, and a control circuit for generating an output signal upon receipt of both an output pulse of the astable multivibrator and output of the signal generating circuit to control the triac thyristor in an ON-OFF fashion.

8 Claims, 3 Drawing Figures

HIGH-FREQUENCY HEATING DEVICE FOR VARIABLY CONTROLLING A HIGH FREQUENCY OUTPUT IN A CONTINUOUS OR STEPWISE MANNER

BACKGROUND OF THE INVENTION

This invention relates to a high-frequency heating device capable of variably controlling a high-frequency output continuously or in a stepwise manner.

Where food is cooked using a high-frequency heating device such as an electronic oven etc. it is generally known to use a high-frequency wave of about 2450 MHz. The high-frequency output of the electronic oven of this type has been heretofore controlled by effecting a repeated ON-OFF operation of a power source by means of mechanical contacts. In this control method, however, the range of control is restricted and it is impossible to vary a high-frequency output continuously or in a stepwise manner over a wider range. Furthermore, since the contact is frequently operated in an ON-OFF fashion, damage to the contact is liable to occur with the resultant short life of the contact and, consequently, this method proves less reliable and disadvantageous from the practical viewpoint.

To obviate such drawbacks, use is made, in place of such mechanical contacts, of a semiconductor controlled rectifying element such as a thyristor in an attempt to control the thyristor in an ON-OFF fashion according to a pulse generated from a pulse oscillator and at the same time control the ratio between the ON time and OFF time of the thyristor by varying a pulse width. In this control method, however, since the timing in which the thyristor is switched over from a non-conductive state to a conductive state is varied with the level of a power source voltage a larger surge current is generated from a high-tension transformer for supplying a high voltage to a magnetron each time the thyristor is rendered conductive. The service life of the thyristor is therefore shortened due to such a large surge current and, in the worst case, the thyristor is destroyed with the attendant disadvantage. Furthermore, since the timing in which the thyristor is rendered conductive is varied, a transient magnetic flux occurs each time the thyristor is rendered conductive. This causes an electromagnetic sound (beat) to be generated from an electronic oven to give an unpleasant feeling to a neighboring person.

It is accordingly the object of this invention to provide a high-frequency heating device capable of controlling a high-frequency output continuously or in a stepwise manner without involving any large surge current and any electromagnetic sound.

According to one aspect of this invention there is provided a high-frequency heating device comprising a semiconductor controlled rectifying element, a transformer with a primary winding coupled through the semiconductor controlled rectifying element to an AC power source, a high-frequency oscillator coupled to a secondary winding of the transformer, a signal generating circuit operated in accordance with a cycle of an AC power source voltage to generate a signal at a predetermined phase of each cycle of the power source voltage, an astable multivibrator whose output pulse width is variable, and a control circuit for generating an output signal upon receipt of both an output of the astable multivibrator and output of the signal generating circuit to control the semiconductor controlled rectifying element in an ON-OFF fashion.

DETAILED DESCRIPTION OF THE INVENTION

Figure 1:
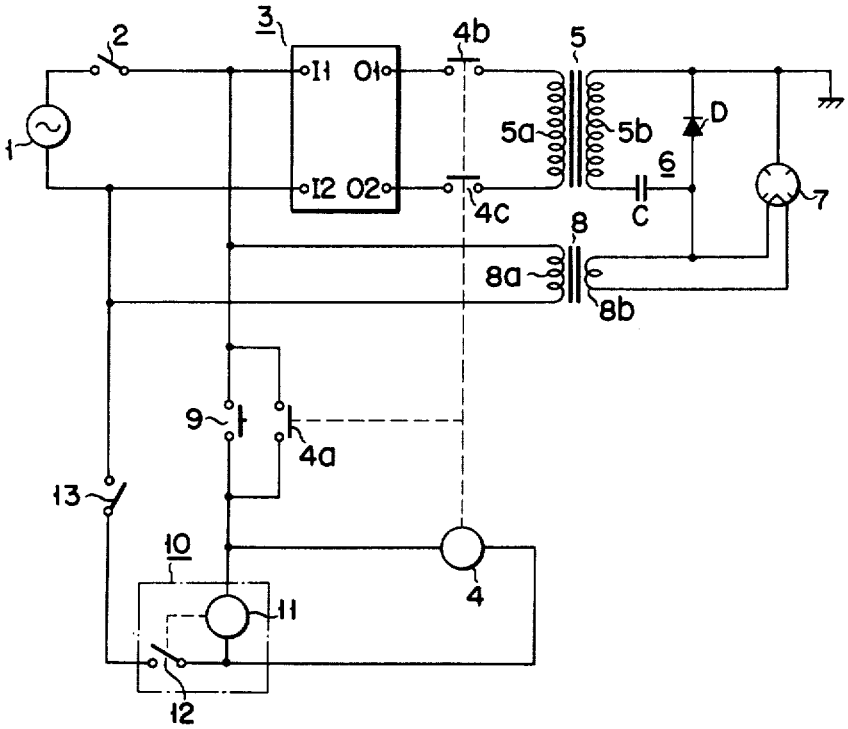
FIG. 1 is a circuit arrangement of a high-frequency heating device according to one embodiment of this invention.

A high-frequency heating device shown in FIG. 1 has an output control circuit 3 coupled through a power source output 2 to an AC power source of, for example, AC 120V at 60Hz. The output terminals 01, 02 of the output control circuit 3 are coupled through respective main contacts **4*b*, 4*c* of an electromagnetic switch 4 to a primary winding 5*a* of a high-tension transformer 5. A magnetron 7 is connected through a rectifying circuit 6 consisting of a capacitor C and a diode D to a second winding 5*b* of the high-tension transformer 5. To the input terminals I1, I2 of the output control circuit 3 is connected a primary winding 8*a* of a transformer 8 for a heater of the magnetron 7. A secondary winding 8*b* of the transformer is connected to the heater of the magnetron 7. To the input terminals I1, I2 is connected a serial circuit consisting of a push-button switch 9 for starting cooking, a motor 11 of a cooking time set timer 10, a time-limit contact 12 of the timer, and a door switch 13. A normally open contact 4*a* of the electromagnetic switch 4 is connected in parallel with the switch 9, and the electromagnetic switch 4 is connected to the motor 11.**

Figure 2:
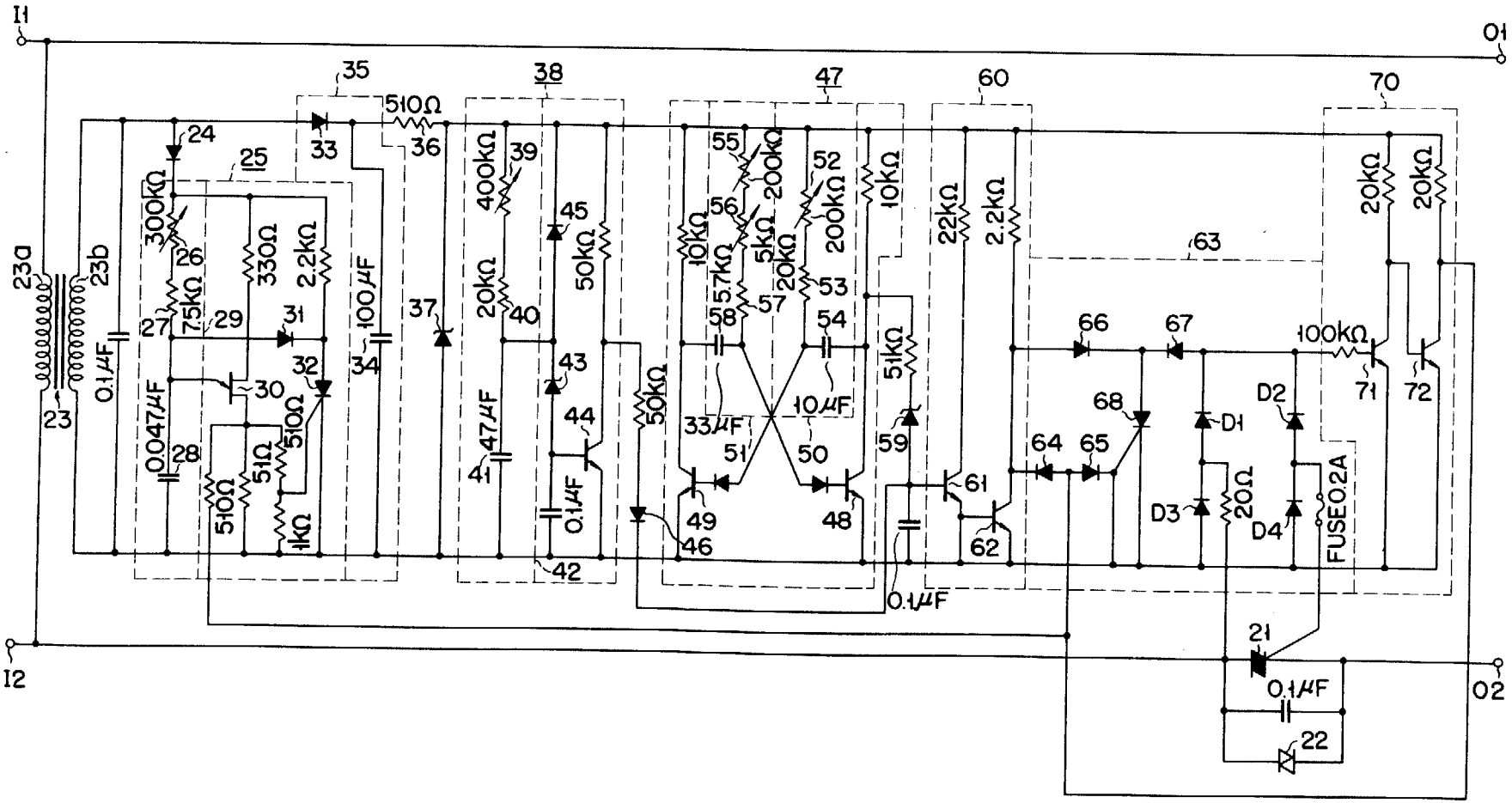
FIG. 2 is an explanatory view showing an output adjusting circuit of the high frequency heating circuit of FIG. 1.

The output control circuit 3 will be more fully explained by reference to FIG. 2.

Between the input I2 and output 02 is connected a semiconductor controlled rectifying element, for example, triac a thyristor 21. A protection varistor 22 is connected in parallel with the thyristor 21. Between the input terminals I1 and I2 is connected a primary winding **23*a* of a transformer 23 for transforming, for example, an input voltage of 120V into 14V. A secondary winding 23*b* of the transformer 23 is connected through a diode 24 to a signal generating circuit 25. The signal generating circuit 25 is operated according to the cycle of voltage of the AC power source to generate a signal at a desired phase of each cycle of the voltage and has a time constant circuit 29 including a series circuit consisting of a variable resistor 26, resistor 27 and capacitor 28, a unijunction transistor 30 operated in response to an output signal of the time constant circuit 29, diode 31 creating a discharge circuit for the capacitor 28, and silicon controlled rectifier (SCR) 32. An output signal of the signal generating circuit is applied to a control circuit 63** to be described later.

To a secondary winding **23*b* of the transformer 23 is connected a rectifying circuit 35 consisting of a diode 33 and a smoothing capacitor 34. Between the output terminals of the rectifying circuit 35 i.e. the terminals of the smoothing capacitor 34 a constant voltage diode 37 is connected through resistor 36. Between the terminals of the diode 37 is connected a delay circuit 38. The delay circuit 38 has a time constant circuit 42 including a variable resistor 39, resistor 40 and capacitor 41,** constant voltage diode 43, NPN type transistor 44, and a diode 45 creating a discharge path for the capacitor 41, and is adapted to apply an output signal through a diode 46 to an amplifying circuit 60 after application of a power source voltage to the input terminals I1 and I2 of the output control circuit 3 to cause the operation of the amplifying circuit 60 to be stopped for a predetermined time period to permit the thyristor 21 to be turned OFF. Between the terminals of the constant voltage diode 37 is connected a pulse oscillator, for example, an astable multivibrator circuit 47, capable of varying the pulse width of an output pulse. The multivibrator circuit 47 includes NPN type transistors 48, 49 and time constant circuits 50, 51 for controlling the ON-OFF operation and ON-OFF time of the transistors 48, 49. The time constant circuit 50 has a variable resistor 52, resistor 53 and capacitor 54 and is adapted to control the ON time (T1) of the transistor 48 and OFF time (T1) of the transistor 49, while the time constant circuit 51 has variable resistors 55, 56, resistor 57 and capacitor 58 and is adapted to control the OFF time (T2) of the transistor 48 and ON time (T2) of the transistor 49. Thus, the pulse width of an output pulse of the multivibrator circuit 47 is varied by the time constant circuits 50, 51.

Between the output terminals of the multivibrator circuit 47 i.e. between the emitter and collector of the transistor 48 is connected a switching element, for example a time constant diode 59, for effecting a switching operation in response to an output of the multivibrator circuit 47. An output of the diode 59 is applied to the amplifying circuit 60. The amplifying circuit 60 includes NPN type transistors 61, 62 for effecting an ON-OFF operation in response to the switching operation of the time constant diode 59. To the output terminal of the amplifying circuit 60 is connected the control circuit 63 for controlling the thyristor 21 in an ON-OFF fashion in response to the presence of an output signal of the amplifying circuit 60, output signal of the signal generating circuit 25 and output signal of a voltage detection circuit 70 to be described later. The control circuit 63 includes diodes 64–67, SCR 68 adapted to be controlled in an ON-OFF fashion according to the presence of an output signal of the signal generating circuit 25 which is led through these diodes 64–67, output signal of the amplifying circuit 60 and output signal of the voltage detection circuit 70, and bridge circuit 69 consisting of diodes D1-D4 which supply a gate signal to the thyristor 21 in response to the operation of SCR 68.

Between the terminals of the constant voltage diode 37 is connected through the bridge circuit 69 the voltage detection circuit 70 for detecting a voltage across the thyristor 21. The voltage detection circuit 70 includes NPN type transistors 71, 72 adapted to be operated in an ON-OFF fashion in response to a voltage across the thyristor.

The high-frequency heating device is operated when the power source switch is thrown in. This causes a power source voltage to be applied to the heater transformer 8 to allow the heater of the magnetron 7 to be heated and at the same time the power source voltage is applied between the input terminals I1 and I2 of the output control circuit 3. When a food is introduced into a heating chamber and a door is shut, the door switch 13 is closed. Upon the throw-in of a cooking switch 9 after the timer is set to a time required for cooking, the time-limit switch 12 of the timer is closed and the electromagnetic switch 4 is energized to cause the normally open contact **4*a* to be closed and self-sustained and the main contacts 4*b*, 4*c*** are closed.

When a power source voltage is applied between the input terminals I1 and I2 of the output control circuit 3 a charging current flows into the time constant circuit 29 to cause the capacitor 28 to be charged. When a charging voltage of the capacitor 28 reaches a predetermined value, the unijunction transistor 30 is turned on and the output signal of the signal generating circuit 25 is applied to the control circuit 63. Conduction of the unijunction transistor 30 causes SCR 32 to be turned on and the capacitor 28 is discharged through diode 31 and SCR 32. In this case, for each cycle of the power source voltage the capacitor 28 begins to be charged from a zero potential of the power source voltage and continues to be charged in accordance with a CR time constant determined by the variable resistor 26, resistor 27 and capacitor 28 and when the charging level of the capacitor reaches a predetermined level, the unijunction transistor 30 is turned on. Therefore it is possible to generate an output signal from the signal generating circuit 25 at a desired phase of the power source voltage with respect to the zero level of the power source voltage as a reference by varying the resistance value of the variable resistor 26.

A charging current flows into the capacitor 41 of the delay circuit 38 in accordance with a CR time constant determined by the variable resistor 39, resistor 40 and capacitor 41. The transistor 44 is held nonconductive until the charging voltage of the capacitor 41 reaches a predetermined value and an output signal of the delay circuit 38 is applied to an amplifying circuit 60 to cause the transistor 61 to be short-circuited between the base and the emitter thereof. Thus, the amplifying circuit 60 does not effect its amplifying operation.

The multivibrator circuit 47 effects an oscillation operation in accordance with a time constant of the time constant circuits 50, 51. That is, the transistors 48 and 49 of the multivibrator circuit 47 alternately effect ON-OFF operation in accordance with the time constant circuits 50 and 51. The constant voltage diode 59 effects an ON-OFF operation in response to the output of the multivibrator circuit 47 and an output signal of the multivibrator circuit 47 is applied through the constant voltage diode 59 to the amplifying circuit 60. More particularly, when the transistor 48 is turned off and its collector voltage becomes larger than a Zener voltage of the constant voltage diode 59, the diode 59 is turned on to permit a voltage to be applied to the base of the transistor 61. On the other hand, when the transistor 48 is turned on and its collector voltage becomes smaller than a Zener voltage of the constant voltage diode 59, the diode 59 is turned on and no voltage is applied to the base of the transistor 61. In this way, the output signal of the multivibrator 47 is applied through the constant voltage diode 59 to the amplifying circuit 60 and as far as the amplifying circuit 60 stops its operation by the delay circuit 38 the control circuit 63 is not operated. Thus, the thyristor 21 is held in the OFF state and the magnetron is not oscillated.

When the main switches **4*b*, 4*c* are closed by the energization of the electromagnetic switch 4, a power source voltage is applied across the thyristor 21. The AC power source voltage is detected through the bridge circuit 69 by the voltage detection circuit 70. If a voltage is being applied across the thyristor 21, the transistor 71 is conducted to cause the transistor 72 to be rendered nonconductive and an output of the voltage detection circuit 70 is applied to the control circuit 63. If voltage is not applied across the thyristor 21, the transistor 71 is rendered nonconductive and the transistor 72 is rendered conductive and an output signal of the signal generating circuit 25 is bypassed through the so conducted transistor 72. Therefore, even if an output signal is generated from the multivibrator circuit 47, the control circuit 63** is not operated.

At the delay circuit 38, when a predetermined time determined by the time constant circuit 42 lapses, i.e. a charging voltage of the capacitor 41 becomes greater than a Zener voltage of the constant voltage diode 43, the transistor 44 is rendered conductive. This causes a collector potential of the transistor 44 to become substantially zero to permit the amplifying circuit 60 which has heretofore stopped its operation to be enabled. That is, upon conduction of the transistor 44 the short-circuit between the base and the emitter of the transistor 61 is released and the transistors 61, 62 of the amplifying circuit 60 are controlled in an ON-OFF fashion in accordance with the switching operation of the constant voltage diode 59 and an output signal of the amplifying circuit 60 is applied to a control circuit 63. The control circuit 63 is operated to cause the thyristor to be operated in an ON-OFF fashion when the amplifier 60, signal generating circuit 25 and voltage detection circuit 70 simultaneously generate their output signals. In other words, only when the unijunction transistor 30 of the signal generating circuit 25 is rendered conductive, the transistors 61, 62 of the amplifying circuit 60 are rendered nonconductive and the transistor 72 of the voltage detection circuit 70 is in the nonconductive state, SCR 68 of the control circuit 63 is turned on and thyristor 21 is turned on. The timing in which thyristor 21 is turned on may be set to a predetermined phase of each cycle of a power source voltage, with a zero level of the power source voltage as a reference, by varying a resistance of the variable resistor 26 of the signal generating circuit 25.

After the power source switch is thrown in to cause a power source voltage to be applied between the input terminals I1 and I2 of the output control circuit 3, the constant voltage diode 43 is held in the OFF state during a predetermined time period determined by the delay circuit 42 and the transistors 61, 62 of the amplifying circuit 60 are held in the conductive state. Therefore, the thyristor 21 is not conducted and no voltage is applied to the magnetron 7. After lapse of a predetermined time period the thyristor is operated in an ON-OFF fashion. That is, a high voltage is not applied to the magnetron 7 until the heater of the magnetron 7 is completely heated and after the heater of the magnetron 7 is completely heated a high voltage is applied to the magnetron 7 to effect its operation.

Suppose now that the thyristor 21 is turned on. Then, a power source voltage is applied to the high-tension transformer 5 to cause the magnetron 7 to oscillate. Thereafter, when the thyristor 21 is turned off, a supply of the high voltage to the high-tension transformer 5 is interrupted to cause the magnetron 7 to stop its oscillation.

Upon lapse of a predetermined time period after application of the power source voltage between the input terminals I1 and I2 of the output control circuit 3, the thyristor 21 is cyclically operated in an ON-OFF fashion and the magnetron 7 repeats its oscillating operation and cooking is initiated under a high-frequency electric power. After lapse of a time period set by the timer 10, the timer 10 opens the time-limit contact 12 to cause the electromagnetic switch 4 to be de-energized. As a result, the self-retaining of the normally open contact 4a is interrupted and the main contacts 4b, 4c are opened. Since a supply of a voltage to the high-tension transformer 5 is interrupted, the magnetron 7 stops its operation and the cooking of food is finished. In this case, unless the power source switch 2 is opened, the output control circuit 3 continues to be operated and the heater of the magnetron continues to be heated. Thus, a next cooking can be initiated immediately.

Explanation will now be made of the operation of the multivibrator circuit 47 in a case where a high-frequency average output is variably controlled.

A time constant of the time constant circuit 51 is varied by varying the resistance of the variable resistor 55 of the multivibrator 47 and the pulse width of an output pulse of the multivibrator 47 is controlled in accordance with the variation of the time constant. More particularly, when the resistance of the variable resistor 55 is varied, the ON time (T1) of the transistor 48 and OFF time (T1) of the transistor 49 are maintained constant, and the OFF time (T2) of the transistor 48 and ON time (T2) of the transistor 49 are varied. Therefore, the ON time of the thyristor 21 is constant and the OFF time thereof is continuously varied. This causes a high-frequency average output of the magnetron 7 to be controlled. With $T_{ON}$ taken to denote the ON time of the thyristor 21, $T_{OFF}$ the OFF time of the thyristor 21 and $P_O$ the high-frequency output of the magnetron 7, the high-frequency average output P of the magnetron 7 will be $$P = P_0 \times \frac{T_{ON}}{T_{ON}+T_{OFF}}.$$

Figure 3:
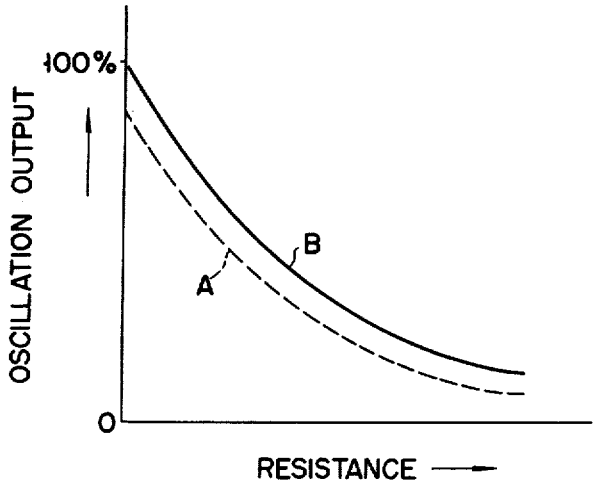
FIG. 3 is an explanatory view showing an output characteristic of the high-frequency heating circuit.

In this way, it is possible to control the output of the magnetron 7 by varying the resistance of the variable resistor 55 to cause the time (T2) to be varied. However, the time (T2) is not made zero due to the presence of the fixed resistance 57, even if the resistances of the variable resistors 55, 56 are made zeros. The presence of the resistor 57 prevents a breakage of the transistor 48 due to an excess flow of a base current after a base resistance of the transistor 48 is made zero. As shown by a curve A in FIG. 3, even if the resistances of the variable resistors 55, 56 are made minimum i.e. zeros, a high-frequency output does not attain a maximum ($P=P_0$; 100 percent). According to this invention, therefore, the multivibrator 47 is so designed that when the resistance of the variable resistor 55 is made substantially zero the output of the multivibrator becomes less than a predetermined level, in this embodiment, less than a Zener voltage of the constant voltage diode 59. When, for example, the resistance of the variable resistor 55 is set to zero, the transistor 48 is made to be switched over from the nonconductive state to the conductive state before a collector voltage of the transistor 48 reaches a Zener voltage of the constant voltage diode 59. Therefore, when the resistance of the variable resistor 55 is set to zero to obtain a maximum output, the constant voltage diode 59 is continuously held in the nonconductive state irrespective of an output of the multivibrator 47 and, equivalently, there is obtained the same result as in the case where the time (T2) is set to zero. In this case, no base current flows through transistors 61, 62 and the transistors are continuously held in the nonconductive state and the thyristor 21 is continuously held in the conductive state. Thus, a maximum high-frequency output is provided. It is in this way possible to vary a high-frequency output from a relatively small value up to a maximum output (100 percent) as shown by a curve B in FIG. 3 by varying the variable resistor 55. Since according to this embodiment the timing in which the thyristor 21 is turned on can be optionally selected, as explained above, through the use of the signal generating circuit 25 operated in accordance with the cycle of the power source voltage to generate a signal in a desired phase of the power source voltage with a zero voltage of the power source voltage as a reference, it is possible to reduce to minimum a surge current generated when the thyristor is turned on. In the circuit arrangement of FIG. 2, when a voltage firstly applied to the diode D upon conduction of the thyristor 21 is a reverse direction voltage, the range of the phase angle of a voltage on thyristor 21 over which a surge current is reduced to minimum (less than an ordinary current peak value) is 80°–130° and when a voltage firstly applied to the diode D upon conduction of the thyristor 21 is a forward direction voltage, said range is 90°±18°. In the former case, the capacitor C is not firstly charged and, when the transformer 5 is energized to cause a current to flow through secondary winding **5*b* of the transformer 5, a current reverse in direction to the secondary current flows through the capacitor C to cause them to cancel each other. Thus, it is considered possible to obtain a broader minimum range of surge current than in the latter case. Consequently, if the signal generating circuit 25 is so designed to produce an output signal that the thyristor is rendered conductive only in the former case, it is possible to reduce surge current to minimum. By setting a CR time constant of the time constant circuit 29 so that the unijunction transistor 30 is rendered conductive at such a phase (phase angle 90°) as the power source voltage is maximum, the thyristor 21 is switched over to a conductive state in accordance with the output of the multivibrator 47** only when the power source voltage becomes substantially maximum.

It is in this way possible to reduce to a much smaller magnitude than in the prior art, a surge current generated when the thyristor 21 is switched over from a nonconductive state to a conductive state. Consequently, a service life of the thyristor 21 is lengthened and a breakage of the thyristor 21 is prevented. Furthermore, it is possible to prevent generation of an electromagnetic sound (beat) in an electronic oven due to a transient magnetic flux produced in the high-tension transformer each time the thyristor is rendered conductive.

Where voltage is not applied across the thyristor 21, the thyristor is held nonconductive and no surge current is produced. When the main contacts **4*b*, 4*c* are closed upon conduction of the thyristor 21, a larger surge current is likely to flow. To prevent a flow of such surge current, a voltage across the thyristor is detected according to the present invention by the voltage detection circuit 70 and when a voltage is applied across the thyristor 21 a signal from the signal generating circuit 25 is by-passed through voltage detection circuit 70 to prevent the thyristor 21 from being rendered conductive. In this case, even if a signal for making the thyristor 21 conductive is generated, the thyristor 21 is not rendered conductive. The thyristor 21 is rendered conductive at a predetermined phase angle (no surge current is produced) after the main contacts 4*b*, 4*c* are closed to cause a voltage to be applied across the thyristor 21.**

Though one embodiment has been explained in connection with this invention, this invention is not restricted only to this embodiment. For example, the value of each element shown in FIG. 2 should not be taken in a restrictive way and it will be understood that the value may suitably be varied. In the above-mentioned embodiment, where no voltage is applied across the thyristor 21, the thyristor 21 is held nonconductive by the voltage detection circuit 70 for detecting a voltage across the thyristor 21, however, where the main contacts **4*b*, 4*c* of the electromagnetic switch 4 are connected to the input side (not the output side as in the above-mentioned embodiment) of the output control circuit 3, the voltage detection circuit 70 may be omitted. With the above-mentioned embodiment, use is made, as a semiconductor controlled rectifying element, of the bidirectional thyristor 21. Instead, an SCR etc. may be used. Though in the above-mentioned embodiment the ON time of the thyristor 21 is made constant and the OFF time thereof is continuously varied, it is possible to vary the ON time of the thyristor. The resistances of the variable resistors 52, 55** may be varied not continuously, but in a stepwise fashion.

What we claim is:

1. A high-frequency microwave type heating device comprising a semiconductor controlled rectifying element, a transformer including a primary winding coupled through the semiconductor controlled rectifying element to an AC power source, a magnetron high-frequency oscillator coupled to a secondary winding of the transformer, a signal generating circuit operated in accordance with the cycle of a voltage of the AC power source to generate a signal at a predetermined phase angle of each cycle of the power source voltage, a pulse oscillator whose output pulse width is variable, and a control circuit supplied at least with an output of the pulse oscillator and an output of the signal generating circuit to generate a control signal, said control signal of the control circuit being used to control the semiconductor controlled rectifying element; and in which said semiconductor controlled rectifying element is a triac thyristor and said high-frequency heating device further includes an amplifying circuit for amplifying an output signal of the pulse oscillator for application to the control circuit, a delay circuit for supplying upon energization a signal to said amplifying circuit for a predetermined time period to cause the operation of the amplifying circuit to be stopped, thus preventing a pulse from the pulse oscillator from being applied to the control circuit, and a voltage detection circuit for detecting a voltage across the triac thyristor to prevent an output signal from the signal generating circuit from being applied to the control circuit when no voltage is applied across the triac thyristor.

2. The high-frequency heating device according to claim 1 in which said pulse oscillator is an astable multivibrator.

3. The high-frequency heating device according to claim 1 further including a voltage detection circuit for detecting a voltage across the semiconductor controlled rectifying element to prevent an output signal from the signal generating circuit from being applied to the control circuit when no voltage is applied across the semiconductor controlled rectifying element.

4. The high-frequency heating device according to claim 1 in which said signal generating circuit includes a first series circuit having a first resistor and a capacitor, a unijunction transistor having a first and a second base connected between both the terminals of the first series circuit and an emitter coupled to a junction between the first resistor and the first capacitor, and a series circuit having a thyristor and a diode and coupled in parallel with the first capacitor to be operated by an output signal of the unijunction transistor when the unijunction transistor is turned on; said delay circuit includes a second series circuit having a second resistor and a second capacitor, a third series circuit having a constant voltage diode and a third capacitor and coupled in parallel with the second capacitor so that the constant voltage diode may be rendered conductive when the charging voltage of the second capacitor reaches a predetermined value; and said pulse oscillator is an astable multivibrator.

5. The high-frequency heating device according to claim 4 in which said bidirectional thyristor transmits a signal to the control circuit at a phase of a power source voltage as determined by a CR time constant of the first resistor and first capacitor to be operated at a phase of 72°–130° of the power source voltage with a zero level of the power source voltage as a reference.

6. The high-frequency heating device according to claim 1 further including an amplifying circuit for amplifying the output signal of the pulse oscillator, the output signal of which is supplied to the control circuit and a delay circuit for supplying upon energization to the amplifying circuit a signal which causes, for a predetermined time period, the operation of the amplifying circuit to be stopped, thus preventing a pulse from the pulse oscillator from being applied to the control circuit.

7. The high-frequency heating device according to claim 1 further including a rectifying circuit having a capacitor and a diode and coupled in parallel with the secondary winding of said transformer to cause a backward direction voltage to be applied firstly to said diode when said control signal of the control circuit causes the semiconductor controlled rectifying element to be rendered conductive at a phase angle of 80°–130° of the power source voltage, said phase angle being taken with the zero level of the power source voltage as a reference.

8. The high-frequency heating device according to claim 1 further including a rectifying circuit having a capacitor and a diode and coupled in parallel with a secondary winding of said transformer to cause a forward direction voltage to be applied firstly to said diode when said control signal of the control circuit causes said semiconductor controlled rectifying element to be rendered conductive at a phase angle of 72°–108° of the power source voltage, said phase angle being taken with the zero level of the power source voltage as a reference.

* * * * *